US008161928B2

(12) United States Patent
Kojima et al.

(10) Patent No.: US 8,161,928 B2
(45) Date of Patent: Apr. 24, 2012

(54) CYLINDER HEAD COVER

(75) Inventors: Hirotsugu Kojima, Kariya (JP); Kunihiro Yamaura, Kariya (JP); Yoshiaki Sumiya, Kariya (JP); Takahiro Yamazaki, Okazaki (JP); Kazuya Yoshijima, Okazaki (JP)

(73) Assignees: Toyota Boshoku Kabushiki Kaisha, Aichi-Ken (JP); Toyota Jidosha Kabushiki Kaisha, Aichi-Ken (JP)

( * ) Notice: Subject to any disclaimer, the term of this patent is extended or adjusted under 35 U.S.C. 154(b) by 395 days.

(21) Appl. No.: 12/475,747

(22) Filed: Jun. 1, 2009

(65) Prior Publication Data

US 2009/0301427 A1 Dec. 10, 2009

(30) Foreign Application Priority Data

Jun. 6, 2008 (JP) ..... 2008-149353

(51) Int. Cl.
*F01M 9/10* (2006.01)

(52) U.S. Cl. ..... 123/90.38; 123/193.3; 123/195 C

(58) Field of Classification Search ..... 123/90.38, 123/90.33, 193.3, 193.5, 195 C, 198 E
See application file for complete search history.

(56) References Cited

U.S. PATENT DOCUMENTS 7,121,243 B2 * 10/2006 Yoshijima et al. ..... 123/90.38
7,174,868 B2 2/2007 Yoshijima et al.

FOREIGN PATENT DOCUMENTS

JP 2006-017085 1/2006
JP 2007-100657 4/2007
JP 2007-107479 4/2007

OTHER PUBLICATIONS

English language Abstract of JP 2007-100657, Apr. 19, 2007.
English language Abstract of JP 2007-107479, Apr. 26, 2007.
English language Abstract of JP 2006-017085, Jan. 19, 2006.
U.S. Appl. No. 12/404,572 to Sumiya., which was filed on Mar. 16, 2009.

* cited by examiner

*Primary Examiner* — Ching Chang
(74) *Attorney, Agent, or Firm* — Greenblum & Bernstein, P.L.C.

(57) ABSTRACT

A cylinder head cover is formed by a synthetic resin outer shell, which is molded by inserting a metal valve case, which holds a oil control valve, in a mold. The valve case has a bolt fastening portion for fastening the valve case, together with the outer shell, to the cam cap. The valve fastening portion has a bolt insertion hole. The bolt fastening portion also has a flange that extends radially outward. The flange has through holes. The flange is embedded in the outer shell, and synthetic resin forming the outer shell fills the through holes.

9 Claims, 7 Drawing Sheets

CYLINDER HEAD COVER

BACKGROUND OF THE INVENTION

The present invention relates to a cylinder head cover attached to the cylinder head of an engine, and more particularly, to a cylinder head cover that includes a synthetic resin outer shell and a valve case of an oil control valve, which valve case is firmly fixed to the outer shell by being insert-molded in the outer shell.

Conventionally, a cylinder head cover attached to the cylinder head of an engine has an outer shell, and the outer shell is made of synthetic resin to reduce the weight. A valve case for attaching an oil control valve is installed in the synthetic resin outer shell. Alternatively, the outer shell is molded with the valve case inserted in a mold. A cylinder head cover having a valve case and the outer shell fixed to and integrated with each other as described above has been developed.

Japanese Laid-Open Patent Publication No. 2007-100657 (a first prior art) discloses an attaching structure that facilitates the attachment of a valve case to an outer shell. According to this structure, a valve case is fixed to a cam cap by a bolt passed through a boss of the valve case after the valve case is temporarily joined to an outer shell. Simultaneously, using the bolt, the outer shell and the valve case are secured to each other through a cylindrical body provided on the outer surface of the boss. Also, an O ring is provided between the cylindrical body and the boss, so that oil in the cylinder head cover does not leak to the outside by trickling along the inner surface of the cylindrical body. The O-ring is pressed when the cylindrical body is welded to the outer shell, and tightly held between the lower end of the cylindrical body and the upper surface of the valve case.

Japanese Laid-Open Patent Publication No. 2007-107479 (second prior art) discloses an attaching structure in which a groove is provided between an outer shell and a valve case. Adhesive is provided in the groove to prevent oil from leaking. That is, in this attaching structure, a synthetic resin outer shell 3 and a valve case 2, which form a cylinder head cover 1, are integrally formed by insert molding. The valve case 2 has a bolt fastening portion 5, and the valve case 2 is fixed to a cam cap 4 together with the outer shell 3 by means of a bolt 6. An annular groove 40 is formed in the upper surface of a flange 41 provided on the outer circumference of the bolt fastening portion 5. Adhesive is applied to the groove 40 prior to the molding process of the cylinder head cover 1 in which the valve case 2 is inserted. The adhesive is prevented from being washed away by injected synthetic resin, and remains in the groove 40. Accordingly, the cured synthetic resin and the adhesive of the valve case 2 are jointed to each other. Therefore, in the vicinity of the bolt fastening portion 5, oil is prevented from leaking out of the valve case 2 through the joint portion between the valve case 2 and the outer shell 3.

The attaching structure of the first prior art allows the valve case to be temporarily joined to the outer shell, and therefore facilitates the assembly. However, the first prior art involves burdensome steps, in which the cylindrical body and the outer shell need to be welded to each other, while keeping the O-ring pressed by the end face of the cylindrical body.

In the second prior art, the outer circumferential surface 42 of the flange 41 closely contacts a contact surface 43 of the outer shell 3 after injecting synthetic resin. However, due to the molding shrinkage at the solidification of the synthetic resin, the outer circumferential surface 42 of the flange 41 can slightly separates from the contact surface 43 of the outer shell 3. Repetitive changes between high-temperature environment of the running engine and thermoneutral environment of the stopped engine cause the separation of the contact surface 43 from the outer circumferential surface 42 to advance upward from the lower end of a joint portion 44. This repeatedly applies stress on the adhesive in the groove 40, which eventually destroys the adhesive. As a result, oil can leak to the outside of the valve case 2 through destroyed portion of the adhesive.

SUMMARY OF THE INVENTION

Accordingly, it is an objective of the present invention to provide a cylinder head cover that, even if a valve case is integrated with a synthetic resin outer shell through insert molding when the outer shell forming a cylinder head cover is molded, prevents the formation of gap between contact surfaces of the outer shell and the valve case due to molding shrinkage of the synthetic resin.

To achieve the foregoing objective and in accordance with one aspect of the present invention, a cylinder head cover having a metal valve case and a synthetic resin outer shell is provided. The outer shell is molded with the valve case inserted in a mold. The cylinder head cover includes a cylindrical holding portion and a separation preventing means. The holding portion is part of the valve case and holds a valve body of an oil control valve. The separation preventing means is located between the valve case and the outer shell, and prevents the outer shell from separating from the valve case.

In accordance with another aspect of the present invention, a cylinder head cover having a metal valve case and a synthetic resin outer shell is provided. The outer shell is molded with the valve case inserted in a mold. The cylinder head cover includes a cylindrical holding portion and separation prevention means. The cylindrical holding portion is part of the valve case and holds a valve body of an oil control valve. The cylinder holding portion has an outer circumferential surface. The outer shell is provided to cover the outer circumferential surface of the holding portion, and has an outer circumferential surface. The separation preventing means is provided on the outer circumferential surface of the outer shell, and prevents the outer shell from separating from the valve case.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

Figure 13:
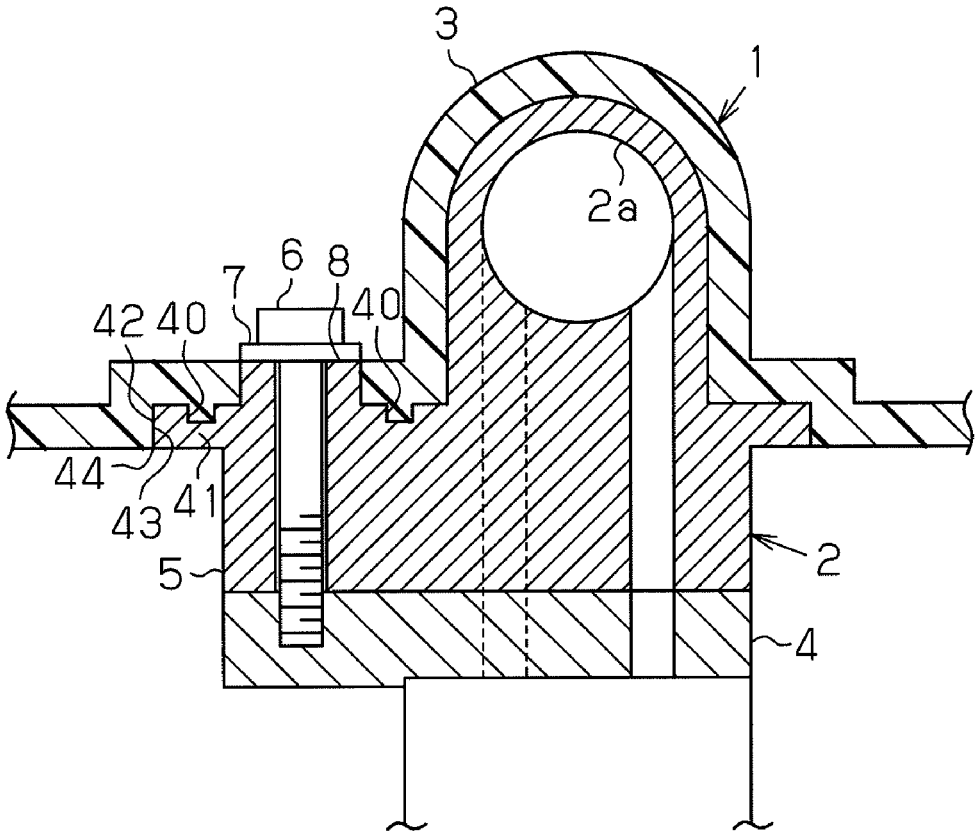
Fig.13 (Prior Art)
FIG. 13 is a cross-sectional view schematically showing a prior art cylinder cover integrated with a valve case.

A cylinder head cover 1 according to a first embodiment of the present invention will now be described with reference to FIGS. 1 to 5. The same reference numerals are given to those components that are the same as the corresponding components of the prior art shown in FIG. 13.

Figure 1:
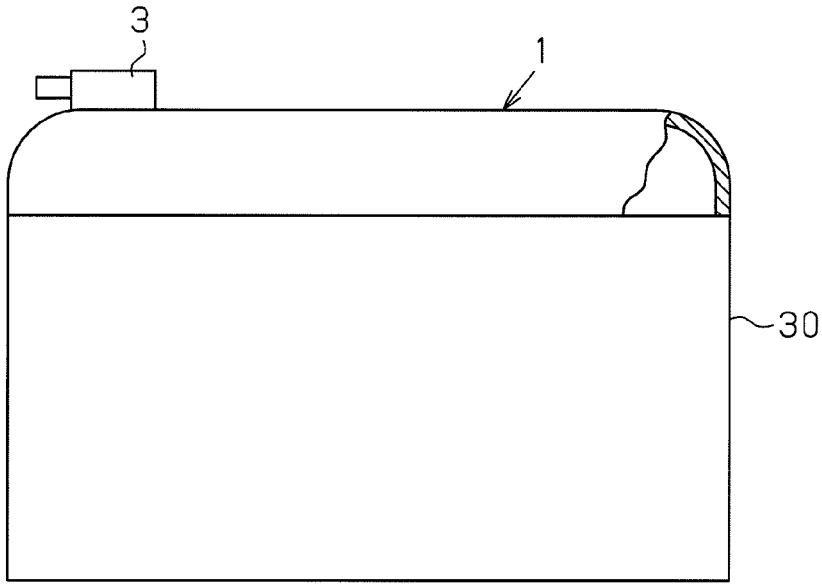
FIG. 1 is a diagram showing the positional relationship between an engine and the outer shell of a cylinder head cover according to a first embodiment of the present invention.

As shown in FIG. 1, the cylinder head cover 1 is fixed to an upper portion of a cylinder block (including the cylinder head) of an engine 30.

Figure 2:
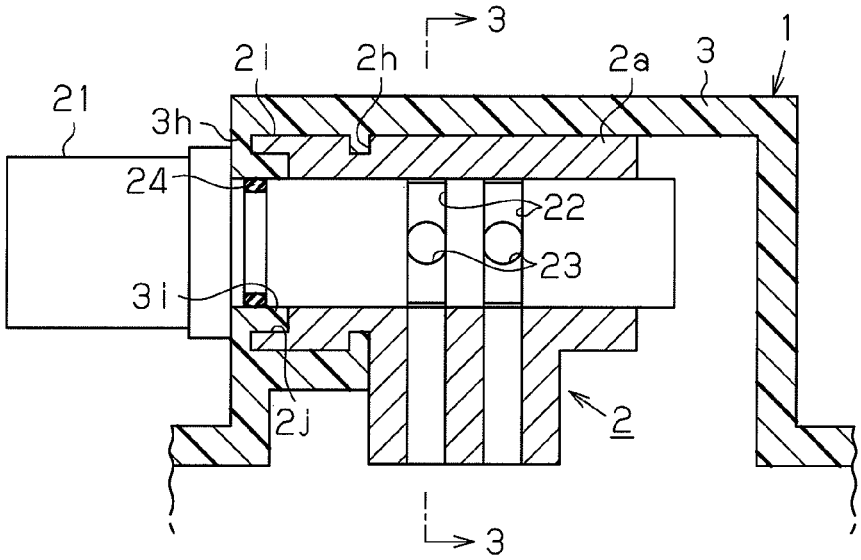
FIG. 2 is a cross-sectional view schematically showing a state in which a valve body is inserted in a valve case of the cylinder head cover shown in FIG. 1.

As shown in FIG. 2, an outer shell of the cylinder head cover 1 is integrally molded of a heat resistant synthetic resin. The cylinder head cover 1 is injection molded, and a metal valve case 2 is integrated with the outer shell 3 through insert molding. The valve case 2 includes a cylindrical holding portion 2*a*. A groove 2*h* is formed in the outer circumference of the holding portion 2*a*. When the outer shell 3 is molded, the groove 2*h* is filled with synthetic resin to fix the outer shell 3 and the valve case 2 to each other, so that the outer shell 3 and the valve case 2 are not displaced from each other.

The holding portion 2*a* of the valve case 2 has an opening 2*i* at an outer end (left end as viewed in FIG. 2). An annular recess 2*j* is formed in the inner circumferential surface of the opening 2*i*. The outer shell 3 of the cylinder head cover 1 has an annular projection 3*h* that extends radially inward at a position outside of the opening 2*i* of the holding portion 2*a*. An entering portion 3*i* is formed at the inner edge of the projection 3*h*. The entering portion 3*i* is located radially inward of the holding portion 2*a* and extends into the recess 2*j* along the axial direction. Between the entering portion 3*i* and the outer shell 3, an end portion of the opening of the holding portion 2*a* is tightly held by the outer shell 3 at the outside and inside of the opening 2*i*.

A valve body 21 of an oil control valve is inserted through the opening 2*i* of the holding portion 2*a* to be installed in the holding portion 2*a*. A seal ring 24 is attached to the outer circumference of the valve body 21 in the vicinity of the opening 2*i* of the valve case 2. The seal ring 24 is located between the inner circumference of the entering portion 3*i* of the projection 3*h* and the outer circumference of the valve body 21. A plurality of oil grooves 22 each having an oil hole 23 are formed in the outer circumferential surface of the valve body 21. When the valve body 21 is assembled with the valve case 2, the inner circumferential surface of the entering portion 3*i* of the projection 3*h* is located outside of the outermost parts of the oil grooves 22.

In the above described cylinder head cover 1, the seal ring 24 is pressed against the entering portion 3*i* of the outer shell 3, so that the sealing performance between the valve case 2 and the valve body 21 is maintained. Thus, even if there is a gap between the valve case 2 and the outer shell 3, the seal ring 24 prevents the gap from communicating with the outside of the valve case 2.

Figure 3:
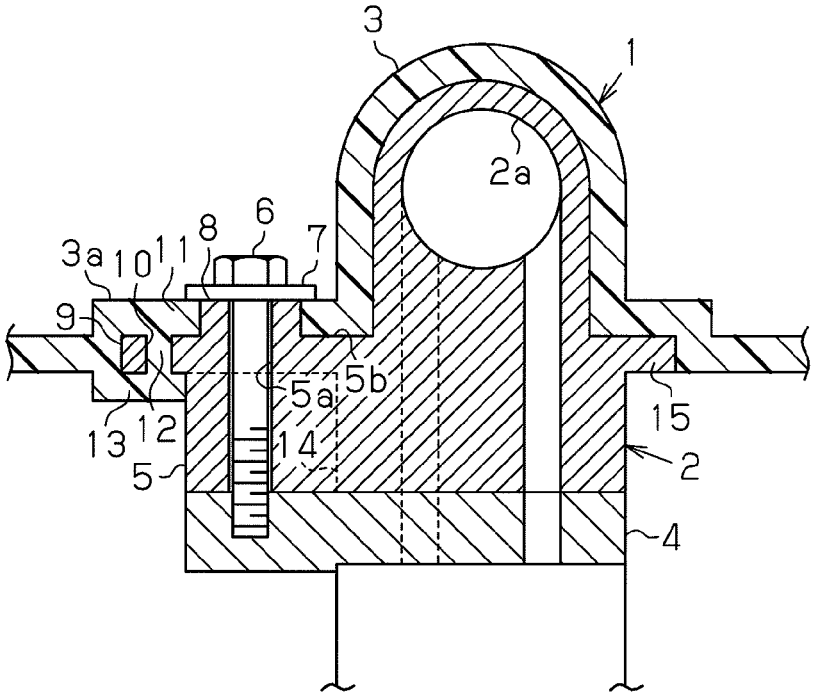
FIG. 3 is a cross-sectional view taken along line 3-3 of FIG. 2.
Figure 4:
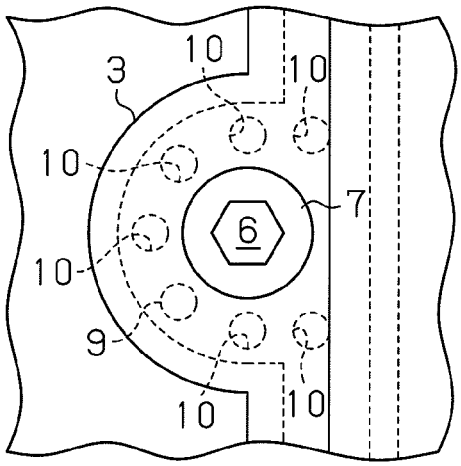
FIG. 4 is an enlarged plan view showing the flange of FIG. 3 and its surroundings.

As shown in FIGS. 3 and 4, the valve case 2 has a bolt fastening portion 5 formed on an outer surface 14. A bolt 6, which is passed through a bolt insertion hole 5*a* of the bolt fastening portion 5, fastens the valve case 2 to the cam cap 4, which is fixed to the cylinder head (not shown), together with the outer shell 3. A seating surface 8 of the bolt fastening portion 5 is formed to project from an upper surface of the bolt fastening portion 5. The seating surface 8 of the bolt fastening portion 5 is located at a position below an upper surface 3*a* of the outer shell 3. Thus, a portion of the outer shell 3 that surrounds the seating surface 8 receives fastening force of the bolt 6 through a washer 7, so as to be compressed. Therefore, in FIG. 3, the upper surface 3*a* of the compressed outer shell 3 is at the same height as the seating surface 8 of the bolt fastening portion 5.

Figure 5:
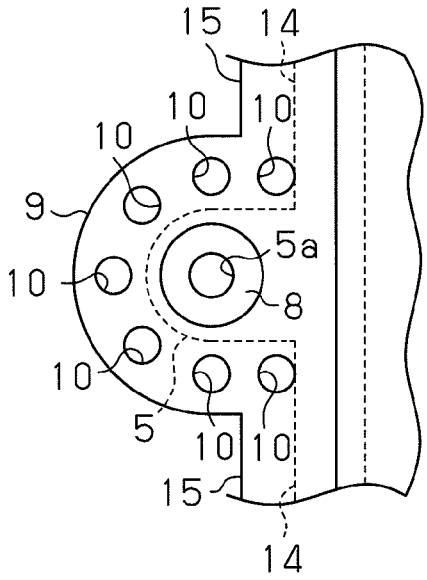
FIG. 5 is an enlarged plan view showing the flange with the outer shell of FIG. 4 removed.

As shown in FIGS. 3 and 5, the bolt fastening portion 5 has a semicircular flange 9 that extends radially outward along an upper surface 5*b*. The flange 9 is embedded in the outer shell 3. The flange 9 has a plurality of through holes 10 extending along the thickness. The synthetic resin covering the flange 9 fills the through holes 10, and the filling resin form coupling portions 12. The outer shell 3 covering the flange 9 includes an upper portion 11 that covers the flange 9 from above and a lower portion 13 covering the flange 9 from below. The coupling portions 12 couple the upper portion 11 and the lower portion 13 to each other. When molding shrinkage of the injected synthetic resin occurs, the coupling portions 12 also shrink. Thus, the upper portion 11 and the lower portion 13 are drawn to the coupling portions 12. Accordingly, the upper portion 11 and the lower portion 13 tightly hold the flange 9. Therefore, the through holes 10 and the synthetic resin filling the through holes 10 function as separation preventing means, so that close contact of the lower surface of the upper portion 11 and the upper surface of the lower portion 13 with the flange 9 is reliably maintained. The through holes 10 are arranged at equal intervals about the bolt insertion hole 5*a*. Also, the flange 9 is coupled to a flange 15 formed on the outer surface 14 of the valve case 2.

Polyamide (PA), polyethylene (PE), and polybutylene terephthalate (PBT) are suitable as the synthetic resin forming the outer shell 3 of the present embodiment. However, any known high-temperature resin may be selected and used as necessary. The valve case 2 of the present embodiment is made of an aluminum alloy.

The cylinder head cover 1 of the above embodiment has the following advantages.

(1) In the above embodiment, the flange 9 extends radially outward along the upper surface 5*b* of the bolt fastening portion 5. The flange 9 is embedded in the synthetic resin forming the outer shell 3. The through holes 10 formed in the flange 9 are filled with the synthetic resin to form the coupling portions 12. Therefore, the flange 9 is tightly held by the upper portion 11 and the lower portion 13, which are pulled toward each other by molding shrinkage of the coupling portions 12. This prevents the formation of gap between the synthetic resin covering the flange 9 and the flange 9. Therefore, oil is prevented from leaking through portions in the vicinity of the bolt fastening portion 5.

(2) In the above embodiment, the through holes 10 are formed about the bolt fastening portion 5 of the flange 9.

Therefore, the bonding between the outer shell 3 and the flange 9 is reinforced at a number of sections about the bolt fastening portion 5. Therefore, oil is prevented from leaking through portions in the vicinity of the bolt fastening portion 5.

(3) In the above embodiment, the seating surface 8 is located at a position below the upper surface 3*a* of the outer shell 3 surrounding the seating surface 8. Thus, the portion of the outer shell 3 that surrounds the seating surface 8 receives fastening force of the bolt 6 through a washer 7, so as to be compressed. The washer 7 applies surface pressure to the upper surface 5*b* of the bolt fastening portion 5. Therefore, oil is prevented from leaking through portions in the vicinity of the seating surface 8.

Second Embodiment

Next, a cylinder head cover 1 according to a second embodiment of the present invention will now be described with reference to FIGS. 6 and 7.

Figure 6:
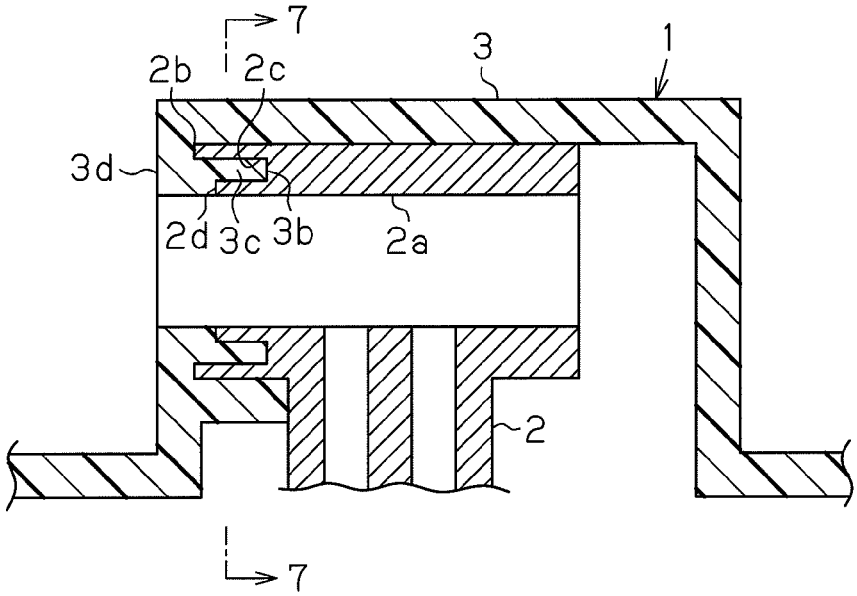
FIG. 6 is a partial cross-sectional view along an axial direction of a holding portion of a valve case, illustrating a cylinder head cover according to a second embodiment of the present invention.
Figure 7:
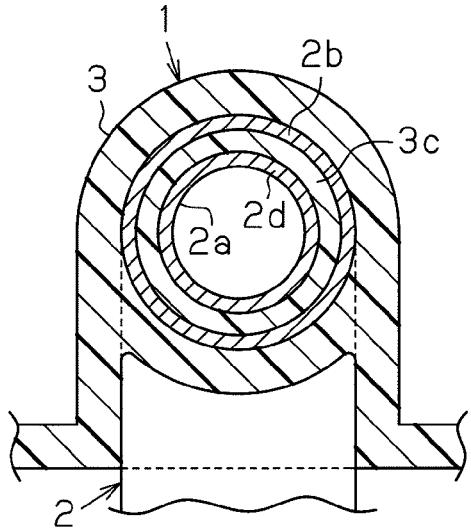
FIG. 7 is a cross-sectional view taken along line 7-7 of FIG. 6.

As shown in FIGS. 6 and 7, an annular recess 2*c* is formed at the distal portion of the holding portion 2*a* of the valve case 2. The annular recess 2*c* forms an annular first protrusion 2*b* located on the outer side and an annular second protrusion 2*d* located on the inner side.

When molding the outer shell 3 of the cylinder head cover 1, most of the valve case 2, which is inserted in the mold, is embedded in the outer shell 3. The first protrusion 2*b* is tightly held by the synthetic resin forming the outer shell 3. The first protrusion 2*b* functions as separation preventing means. Synthetic resin filling the annular recess 2*c* forms an annular third protrusion 3*c*, which protrudes rearward (rightward as viewed in the drawing) from an end portion 3*d* of the outer shell 3. Since an entire distal portion 3*b* of the third protrusion 3*c* is embedded in the annular recess 2*c*, the distal portion 3*b* can hardly be moved in any direction. Therefore, even if the synthetic resin forming the outer shell 3 shrinks, a gap allowing passage of oil is hardly formed between the third protrusion 3*c* and the annular recess 2*c*. When the cylinder head cover 1 is repeatedly heated and let stand to cool, stress is repeatedly applied to the interface between the third protrusion 3*c* and the annular recess 2*c* due to the difference in coefficient of thermal expansion between the outer shell 3 and the valve case 2. Even in such a case, a gap allowing passage of oil is hardly formed between the third protrusion 3*c* and the annular recess 2*c*.

Thus, in addition to the advantages of the first embodiment, the cylinder head cover 1 according to the second embodiment has the following advantages.

(4) In the second embodiment, the first protrusion 2*b* is tightly held by the synthetic resin forming the outer shell 3. Also, the synthetic resin filling the annular recess 2*c* between the first protrusion 2*b* and the second protrusion 2*d* forms the third protrusion 3*c*. This prevents the distal portion 3*b* of the third protrusion 3*c* from warping, which prevents the formation of a gap allowing passage of oil between the third protrusion 3*c* and the annular recess 2*c*. Therefore, even if stress is repeatedly applied to the interface between the third protrusion 3*c* and the annular recess 2*c* due to the difference in coefficient of thermal expansion between the outer shell 3 and the valve case 2, oil is prevented from leaking through the interface between the third protrusion 3*c* and the annular recess 2*c*.

Third Embodiment

A cylinder head cover 1 according to a third embodiment of the present invention will now be described with reference to FIGS. 8 and 9. A valve case 2 according to the third embodiment is different from that of the second embodiment only in that a plurality of through holes 2*e* are formed in the first protrusion 2*b*. Accordingly, the difference will be mainly discussed, and detailed explanations of the same components are omitted.

Figure 8:
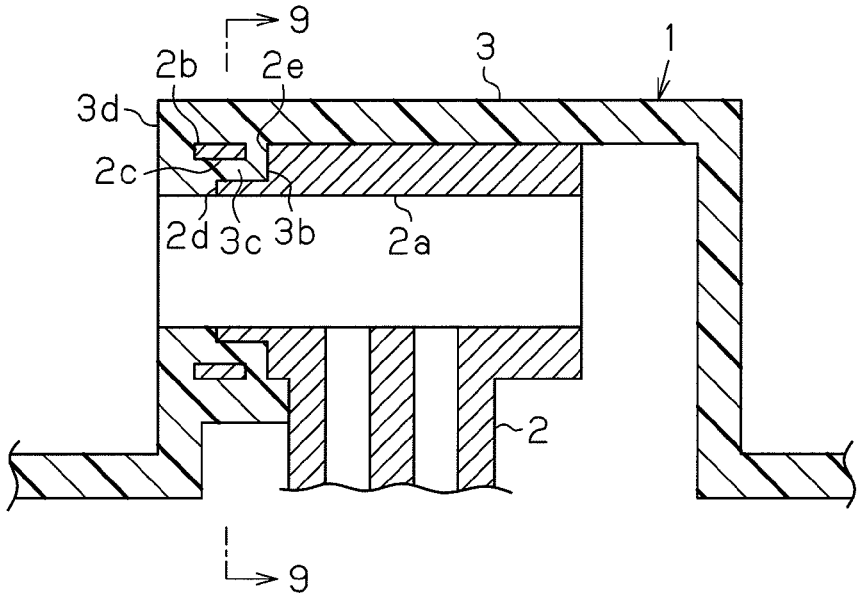
FIG. 8 is a partial cross-sectional view along an axial direction of a holding portion of a valve case, illustrating a cylinder head cover according to a third embodiment of the present invention.
Figure 9:
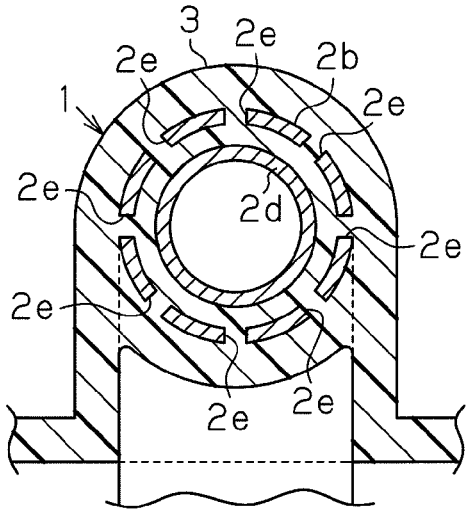
FIG. 9 is a cross-sectional view taken along line 9-9 of FIG. 8.

As shown in FIGS. 8 and 9, eight through holes 2*e* are formed near the proximal end of the first protrusion 2*b* and extend toward the first protrusion 2*b* and along radial directions. The through holes 2*e* are arranged at equal intervals in the circumferential direction of the holding portion 2*a*. The synthetic resin forming the outer shell 3 fills the through holes 2*e*. The filling synthetic resin couples the synthetic resin covering the outer circumferential surface of the holding portion 2*a* and the synthetic resin forming the third protrusion 3*c* to each other. Therefore, even if there is a difference between the coefficient of thermal expansion of the outer shell 3 and that of the valve case 2, a gap allowing passage of oil is hardly formed between the third protrusion 3*c* and the annular recess 2*c* when the synthetic resin forming the outer shell 3 shrinks.

Thus, in addition to the advantages of the first and second embodiments, the cylinder head cover 1 according to the third embodiment has the following advantage.

(5) In the third embodiment, eight through holes 2*e* are formed at equal intervals in the circumferential direction in the vicinity of the proximal end of the first protrusion 2*b*. The synthetic resin covering the outer circumferential surface of the holding portion 2*a* and the synthetic resin forming the third protrusion 3*c* are coupled to each other by the synthetic resin in the through holes 2*e*. Therefore, even if there is a difference between the coefficient of thermal expansion of the outer shell 3 and that of the valve case 2, a gap allowing passage of oil is hardly formed between the third protrusion 3*c* and the annular recess 2*c* when the synthetic resin forming the outer shell 3 shrinks. Accordingly, oil is prevented from leaking through the interface between the third protrusion 3*c* and the annular recess 2*c*.

Fourth Embodiment

A cylinder head cover 1 according to a fourth embodiment of the present invention will now be described with reference to FIGS. 10 to 12.

Figure 10:
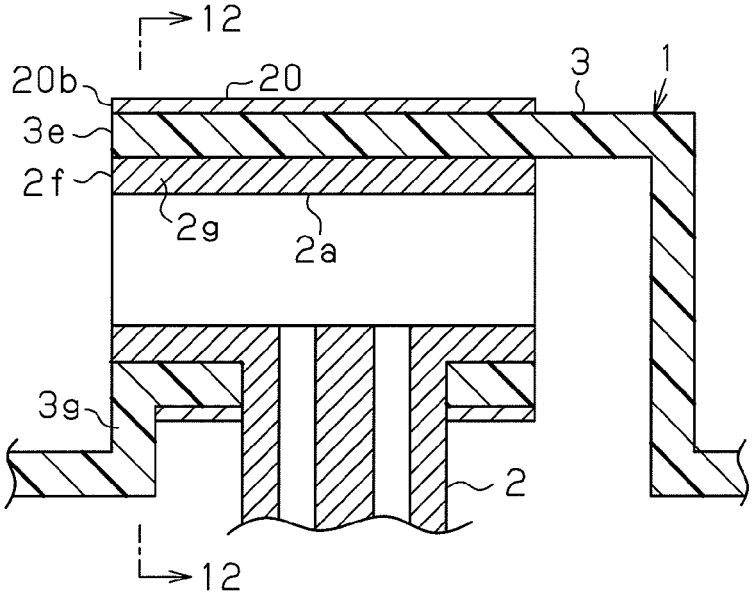
FIG. 10 is a partial cross-sectional view illustrating a cylinder head cover according to a fourth embodiment of the present invention and schematically showing an outer shell at a part where a valve case is integrally molded.
Figure 11:
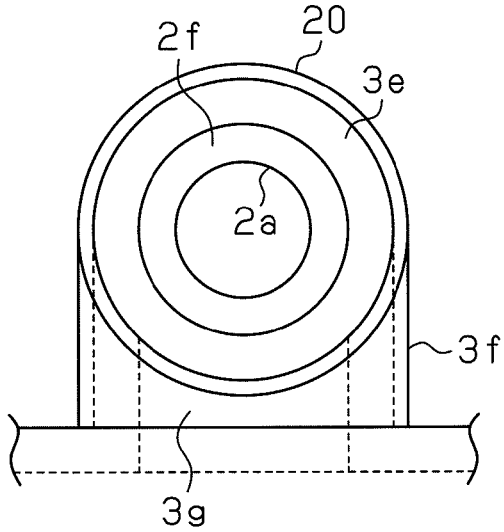
FIG. 11 is a left side view of FIG. 10.

As shown in FIG. 10, a cylindrical body 20, which functions as separation preventing means, is provided to cover the outer circumferential surface of the outer shell 3. The cylindrical body 20 is made of steel, it is surface is plated. Also, when the outer shell 3 of the cylinder head cover 1 is molded, the cylindrical body 20 is inserted in the mold (not shown) together with the valve case 2, and is molded with the outer shell 3. This integrates the cylindrical body 20 with the outer shell 3. An end face 20*b* of the cylindrical body 20, an end face 3*e* of the outer shell 3, and an end face 2*f* of the valve case 2 are arrange to be flush with one another. This configuration prevents the outer shell 3 from separating from the outer circumferential surface of a cylindrical portion 2*g* of the valve case 2.

Figure 12:
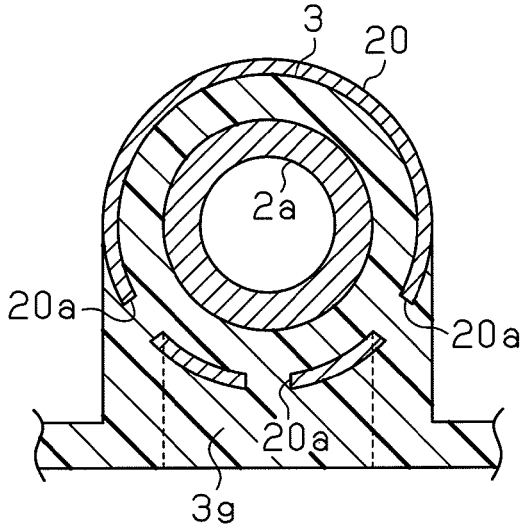
FIG. 12 is a cross-sectional view taken along line 12-12 of FIG. 10.

As shown in FIG. 12, a lower portion of the cylindrical body 20 is covered by the synthetic resin forming the outer shell 3. A three holes 20*a* are formed in the lower portion of the cylindrical body 20. The synthetic resin filling the space between the inner surface of the cylindrical body 20 and the outer circumferential surface of the cylindrical portion 2*g* and the synthetic resin forming an end wall 3*g* of the outer shell 3 are coupled to each other through the three holes 20*a* of the cylindrical body 20. A side wall 3*f* of the outer shell 3 (see FIG. 11) is a building-up portion for preventing the formation of undercut during molding. Therefore, even if the molding is executed with the cylindrical body 20 inserted in the mold (not shown), no undercut is formed.

Thus, in addition to the advantages of the first to third embodiments, the cylinder head cover according to the fourth embodiment has the following advantage.

(6) In the fourth embodiment, the cylindrical body 20 is provided to cover the outer shell 3. Therefore, even if there is a difference between the coefficient of thermal expansion of the outer shell 3 and that of the valve case 2, a portion of the outer shell 3 including the end face 3*e* is prevented from separating from the outer circumferential surface of the cylindrical portion 2*g* of the valve case 2. Thus, since a gap allowing passage of oil is hardly formed between the cylindrical portion 2*g* and the outer shell 3, oil leakage through the interface between the cylindrical portion 2*g* and the outer shell 3 is prevented.

(Modifications)

The present invention may be modified as follows.

In the illustrated embodiments, no seal is provided on the upper surface 5*b* about the seating surface 8. Instead of this, a seal may be provided on the upper surface 5*b* about the seating surface 8. An annular groove is formed on the upper surface 5*b* about the seating surface 8. Any type of seal such as an O-ring or liquid gasket may be provided in the groove.

In the illustrated embodiments, a hexagonal bolt is used as the bolt 6. Instead of this, a bolt having any shape may be used as the bolt 6. For example, a hexagon socket head bolt may be used.

In the illustrated embodiments, the flange 9 on the outer side of the bolt fastening portion 5 is semicircular. Instead of this, the flange 9 may have any shape. For example, the flange 9 may be rectangular.

In the fourth embodiment, three holes 20*a* are formed in the cylindrical body 20. Instead of this, the number of the holes 20*a* may be other than three. Alternatively, the holes 20*a* may be omitted.

Therefore, the present examples and embodiments are to be considered as illustrative and not restrictive and the invention is not to be limited to the details given herein, but may be modified within the scope and equivalence of the appended claims.

What is claimed is:

1. A cylinder head cover having a metal valve case and a synthetic resin outer shell, which is molded with the valve case inserted in a mold, the cylinder head cover comprising:

a cylindrical holding portion that is part of the metal valve case and holds a valve body of an oil control valve;

a separation preventer that is located between the metal valve case and the synthetic resin outer shell and prevents the synthetic resin outer shell from separating from the metal valve case, and a flange that extends outward from the cylindrical holding portion, the entire flange being embedded in the synthetic resin outer shell, wherein the flange has at least one through hole, which is filled with the synthetic resin that forms the synthetic resin outer shell, and wherein the separation preventer is formed by the through hole and the synthetic resin filling the through hole.

2. The cylinder head cover according to claim 1, wherein the metal valve case has an insertion hole for a bolt that is used to fix the metal valve case to the cylinder head cover, and wherein the at least one through hole is located in a section around the insertion hole.

3. The cylinder head cover according to claim 2, wherein the at least one through hole is one of a plurality of through holes, which are arranged at equal intervals about the insertion hole.

4. The cylinder head cover according to claim 3, wherein the flange is semicircular.

5. A cylinder head cover having a metal valve case and a synthetic resin outer shell, which is molded with the valve case inserted in a mold, the cylinder head cover comprising:

a cylindrical holding portion that is part of the metal valve case and holds a valve body of an oil control valve; and a separation preventer that is located between the metal valve case and the synthetic resin outer shell and prevents the synthetic resin outer shell from separating from the metal valve case, wherein the cylindrical holding portion has an end portion, and the synthetic resin outer shell has an end portion that is located in the vicinity of the end portion of the cylindrical holding portion, wherein the separation preventer is located between the end portion of the cylindrical holding portion and the end portion of the synthetic resin outer shell, and wherein at least one of a radially inner portion and a radially outer portion of the end portion of the cylindrical holding portion prevents separation of the end portion of the synthetic resin outer shell.

6. The cylinder head cover according to claim 5, wherein the separation preventer is configured by covering the entire end portion of the cylindrical holding portion with the end portion of the synthetic resin outer shell, and wherein the end portion of the cylindrical holding portion is held between the radially inner portion and the radially outer portion of the end portion of the synthetic resin outer shell, so that separation of the synthetic resin outer shell is prevented.

7. The cylinder head cover according to claim 6, wherein the end portion of the cylindrical holding portion has a through hole, which is filled with the synthetic resin forming the synthetic resin outer shell.

8. The cylinder head cover according to claim 5, wherein the end portion of the cylindrical holding portion has an annular first protrusion and an annular second protrusion formed inside the first protrusion, wherein an annular groove is formed between the first and second protrusions, and wherein the end portion of the synthetic resin outer shell has an annular third protrusion that is located in the annular groove and tightly held by the first and second protrusions.

9. A cylinder head cover having a metal valve case and a synthetic resin outer shell, which is molded with the valve case inserted in a mold, the cylinder head cover comprising:

a cylindrical holding portion that is part of the metal valve case and holds a valve body of an oil control valve, the cylindrical holding portion having an outer circumferential surface, the synthetic resin outer shell being provided to cover the outer circumferential surface of the cylindrical holding portion, and having an outer circumferential surface; and a separation preventer provided on the outer circumferential surface of the synthetic resin outer shell, the separation preventer preventing the synthetic resin outer shell from separating from the metal valve case, wherein the separation preventer includes a cylindrical body covering the outer circumferential surface of the synthetic resin outer shell.

* * * * *